United States Patent [19]

Braak

[11] 4,148,038

[45] Apr. 3, 1979

[54] CIRCUIT ARRANGEMENT FOR MUTUALLY DECOUPLED CONNECTING OF PLURAL TRANSMITTERS

[75] Inventor: Dirk J. Braak, Heroldsberg, Fed. Rep. of Germany

[73] Assignee: Tekade Felten & Guilleaume Fernmeldeanlagen GmbH, Nuremberg, Fed. Rep. of Germany

[21] Appl. No.: 828,627

[22] Filed: Aug. 29, 1977

[30] Foreign Application Priority Data

Sep. 1, 1976 [DE] Fed. Rep. of Germany ..... 2639348

[51] Int. Cl.[2] ..... H01Q 13/00

[52] U.S. Cl. ..... 343/858; 343/786; 343/853

[58] Field of Search ..... 343/858, 854, 853, 786, 343/776–778, 850

[56] References Cited

U.S. PATENT DOCUMENTS 3,295,134 12/1966 Lowe ..... 343/854

3,518,695 6/1970 Schroeder ..... 343/858

*Primary Examiner*—Alfred E. Smith
*Assistant Examiner*—David K. Moore
*Attorney, Agent, or Firm*—Michael J. Striker

[57] ABSTRACT

A non-directional transmitting system non-directionally and simultaneously transmits four signals of different but closely spaced frequency. The system comprises four directional antennas, each oriented to face in a different respective direction, each direction being spaced 90° from the next one. Each directional antenna simultaneously transmits one fourth of the power of each one of the four signals, making for an overall non-directional effect. The four signal sources are coupled to the four directional antennas by way of four 3-dB couplers in such a way that substantially all the power of each signal is transmitted equally to the four directional antennas, avoiding the power loss customary when plural signal sources are coupled to a common non-directional antenna using 3-dB couplers.

8 Claims, 3 Drawing Figures

CIRCUIT ARRANGEMENT FOR MUTUALLY DECOUPLED CONNECTING OF PLURAL TRANSMITTERS

The invention concerns a circuit arrangement for the mutually decoupled connecting of plural transmitters of differing transmitting frequency to an antenna system by means of 3-dB couplers each having two inputs and outputs.

Radio networks which are to serve a densely populated region, for example a large city, with very many mobile radio subscribers, require correspondingly many radiotelephone channels. Only in that way can one achieve a smooth-running flow of radiotelephone traffic, with short waiting times when establishing a radiotelephone connection between a line subscriber of the radiotelephone network and a radio subscriber, and vice versa. However, a large number of radiotelephone channels requires the use of correspondingly many radio transmitters and radio receivers, because each radiotelephone channel requires its own radio transmitter and radio receiver.

If one provides each radio transmitter with a transmitting antenna of its own, then the coupling of a transmitter to its transmitting antenna does not present any problems. Also, the attenuation resulting from coupling is low and use can be made of a transmitter of lower power. However, in such case, the many radio transmitters require correspondingly many transmitting antennas. However, in areas which are densely populated, and therefore have space availability problems, it is very difficult, when not impossible, to set up a plurality of transmitting antennas in a very confined space in such a way that, on the one hand, there is achieved an equal distribution of field strength in the total transmission range and, on the other hand, the transmitting antennas do not affect each other's operation and accordingly produce feedback effects at the coupled radio transmitters, producing for example intermodulation in the end stages.

If, in order to reduce the number of transmitting antennas, one connects several radio transmitters to a common transmitting antenna of correspondingly broad bandwidth, then one must effect the connection by means of decoupling stages, in order to avoid feedback effects at the end stages. If the frequency spacing between the individual transmitter frequencies is sufficiently great, then for the decoupling stages one can use frequency-separating filters such as for example disclosed in German Pat. No. 711 668 and in German allowed patent application No. 1 233 513; these exhibit only a low transmission attenuation. The power of the radio transmitters in that event can still be kept small. However, if the transmitter frequencies are densely spaced, then decoupling by means of frequency-separating filters is no longer possible. In these instances, in order to connect several radio transmitters onto a common transmitting antenna, it is necessary to use so-called 3-dB couplers, known for example from French Pat. No. 1 455 139. However, these, in turn, have the disadvantage that they exhibit a coupling attenuation of 3 dB, so that only about one quarter of the output power of the radio transmitter reaches the transmitting antenna. In order to establish within the transmission area the same field strength as one would achieve with direct coupling of four radio transmitters to four individual transmitting antennas, one must accordingly make the power of the transmitters higher by a multiple of about four.

Accordingly, the aim of the invention is a circuit arrangement for the mutually decoupled connecting of plural radio transmitters of different transmitting frequencies to a common antenna system by means of 3-dB couplers each having two inputs and outputs, such as to make possible the transmission of the total output power of the radio transmitters to the antenna system almost without attenuation. A further object of the invention is to furthermore so design the circuit arrangement that it is simple to set up and requires only a small amount of space.

The invention achieves the stated object as follows: in order to connect four transmitters (S1 to S4) to an antenna system which exhibits directional behavior and is comprised of four identical component antennas (A1 to A4), there are provided four 3-dB couplers (K1 to K4); to the inputs of each of two of the couplers (K1, K3) there is connected a respective transmitter (S1, S2 and S3, S4); to the outputs of the two other couplers (K2, K4) there is each connected a respective antenna (A1, A2 and A3, A4); and the couplers with their other inputs and outputs are connected together one to the other to form a ring, with in each case one output of one coupler being connected to one input of the neighboring coupler, and each coupler which is connected to transmitters being followed by a coupler connected to antennas.

Further advantageous features and concepts of the invention are set forth in dependent claims 2 to 7.

The invention is described in greater detail below with respect to one embodiment of a circuit arrangement for connecting four radio transmitters to an antenna system, with reference to the Figures.

Figure 1:
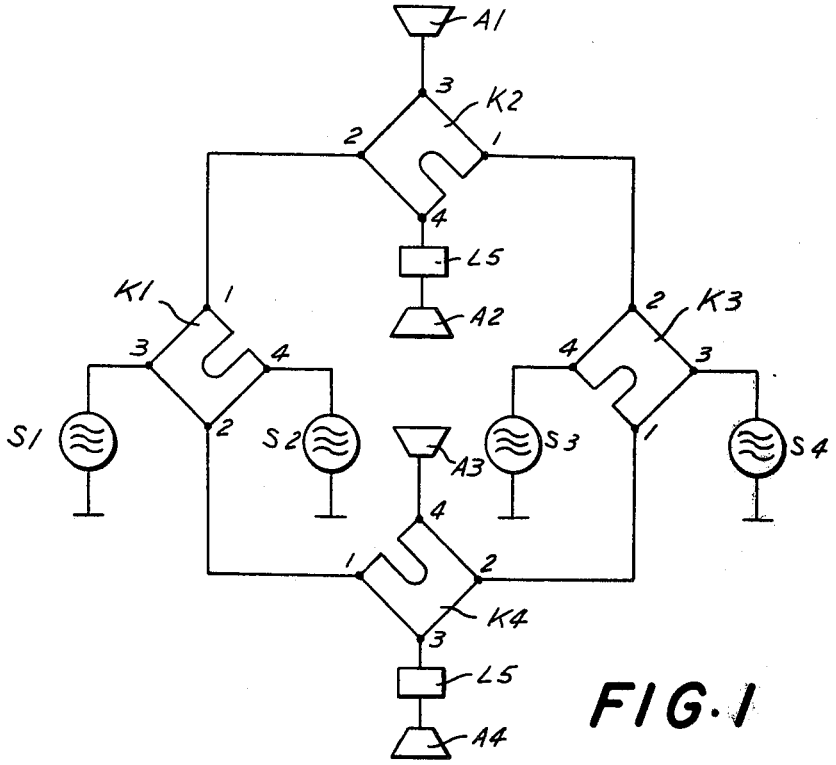
FIG. 1 depicts the electrical circuit diagram for the exemplary inventive circuit arrangement.
Figure 3:
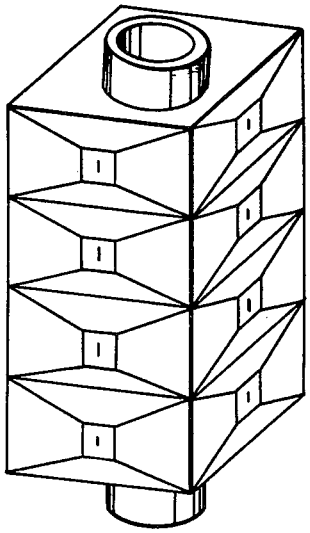
FIG. 3 depicts the storied set-up of a plurality of identical circuit arrangements such as shown in FIG. 2.

In FIG. 1, K1 to K4 denote the four 3-dB couplers. The four 3-dB couplers K1 to K4 are connected, each with its respective input 1 and the diagonally opposite output 2, one after the other in series, and accordingly form a second bridge circuit. The antenna system comprises, in accordance with the invention, four component antennas A1 to A4; the four transmitters S1 to S4 to be connected to the antenna system are each permanently tuned to a different respective transmitting frequency. The four component antennas A1 to A4, as well as the four transmitters S1 to S2, in pairs, are each connected to the respective other input 3 and the respective other output 4 of the 3-dB couplers K1 to K4. In accordance with the invention, the connection is furthermore so performed, that each two transmitters S1, S2; S3, S4 and each two component antennas A1, A2; A3, A4 are connected to the input 3 and output 4 of the next-two-over 3-dB couplers K1, K3 or K2, K4.

The inventive circuit arrangement with four 3-dB couplers accordingly differs from the 3-dB coupler circuits known from German allowed patent application No. 1 219 999, in that it includes no load resistance. In contrast, all known circuit arrangements using 3-dB couplers include a load resistance, in order to connect together two transmitters and one antenna, and such load resistance constitutes an energy-wasting resistor.

As a result, the output power transmitted from the transmitters to the antennas is attenuated to the extent of about 6 dB. In contrast, with the inventive circuit arrangement, each of these load resistors is replaced by either a transmitter or an antenna. As a result, the transmitter power is transmitted to the antenna system almost without attenuation. This means that, in order to achieve the same radiated antenna power as achieved with hitherto known 3-dB couplers, the output power of each of the transmitters S1 to S4 need amount to only about one fourth of what would be necessary with the known arrangements.

In accordance with another concept of the invention, the four bridge branches of the four 3-dB couplers K1 to K4 are each constructed using three lines of length $\lambda/4$ as well as one line of length $3\lambda/4$. Preferably, coaxial lines are used for these lines. The lines present only a very low attenuation for the frequencies to be transmitted.

The input resistances of the component antennas A1 to A4 and the output resistances of the transmitters S1 to S4 are equal to one another and are matched to the characteristic impedance of the 3-dB couplers K1 to K4.

Furthermore, for the component antennas A1 to A4, directional antennas are provided. The directional antennas are in particular designed as $\lambda/2$ dipoles, dimensioned as 90°-reflective radiators with vertical polarization. Each of these directional antennas accordingly has, within a sector of about 90°, a lobe-shaped radiation characteristic which is 3 dB lower in the two radiation directions ±45° to the principal direction of radiation. The directional antennas A1 to A4 are so spatially arranged, that the principal radiation directions of each two directional antennas A1, A3 and A2, A4 are opposite to each other. Additionally, such that the principal radiation directions of the two antenna groups A1, A3 and A2, A4 are perpendicular to each other.

For the four transmitters S1 to S4, the chosen arrangement of directional antennas results in the following phase angles relative to the directional antennas A1 to A4.

| | | | | | | | |
|---|---|---|---|---|---|---|---|
| $S_1$: | $A_1$ 0 | $S_2$: | $A_1$ $\pi$ | $S_3$: | $A_1$ 0 | $S_4$: | $A_1$ 0 |
| | $A_2$ 0 | | $A_2$ $\pi$ | | $A_2$ $\pi$ | | $A_2$ $\pi$ |
| | $A_3$ $\pi$ | | $A_3$ $\pi$ | | $A_3$ $\pi$ | | $A_3$ 0 |
| | $A_4$ 0 | | $A_4$ 0 | | $A_4$ $\pi$ | | $A_4$ O |

In the centers of the intersection regions of each two directional antennas, for example A1/A2; A3/A4, there can accordingly appear radiation minima and thus field strength minima. These are avoided if, in accordance with a further concept of the inventive circuit arrangement, two of the directional antennas radiating in opposite direction, for example $A_2$ and $A_4$, are connected to the 3-dB couplers K2, K4 via a time-delay line L5 having a transmission length about $\lambda/4$ greater than the two other directional antennas A1, A3.

There then results for the four directional antennas A1 to A4 the following relative phase relationships

| | | | | | | | |
|---|---|---|---|---|---|---|---|
| $S_1$: | $A_1$ 0 | $S_2$: | $A_1$ $\pi$ | $S_3$: | $A_1$ 0 | $S_4$: | $A_1$ 0 |
| | $A_2$ $\pi/2$ | | $A_3$ $3\pi/2$ | | $A_2$ $3\pi/2$ | | $A_2$ $3\pi/2$ |
| | $A_3$ $\pi$ | | $A_3$ $\pi$ | | $A_3$ $\pi$ | | $A_3$ 0 |
| | $A_4$ $\pi/2$ | | $A_4$ $\pi/2$ | | $A_4$ $3\pi/2$ | | $A_4$ $\pi/2$ |

In the regions of overlap of the directional antennas A1 to A4, there accordingly appear field strengths which are greater by $\sqrt{2}$ than those which are produced at the same location for one directional antenna. The four directional antennas then produce an approximately circular summed directivity pattern.

Figure 2:
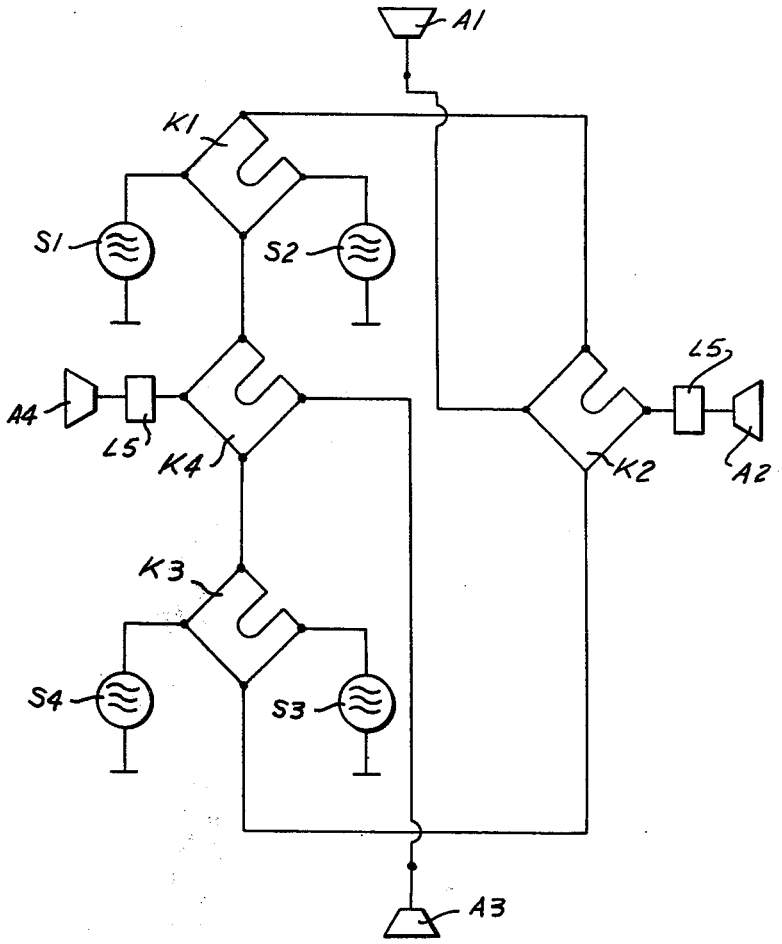
FIG. 2 depicts the spatial arrangement of the antennas of FIG. 1.

A construction of the circuit arrangement which is particularly advantageous, space-saving and logical looking is achieved, if the four directional antennas A1 to A4, designed as angular reflector antennas, as well as the four 3-dB couplers K1 to K4, are, as shown in FIG. 2, combined to form a structural unit. In such event, the four 3-dB couplers K1 to K4 are advantageously arranged between the directional antennas A1 to A4, which latter are set up at right angles to each other. The associated four transmitters S1 to S4 can be set up at a distance from this structural unit, at a convenient location, and be connected to the 3-dB couplers via connecting cables.

If a greater number of radiotelephone channels is provided in a radiotelephone traffic area, and correspondingly many transmitters and transmitting antennas with 3-dB couplers are required, then a plurality of the structural units described above are set up one above the other, in a storied arrangement. Advantageously, the respective four directional antennas A1 to A4 of each group are all secured at the same elevation to a hollow pipe of suitable diameter and appropriate wall thickness, serving as a carrier pipe. The four 3-dB couplers belonging to each antenna group, which are for example made up of concentric conductors, are provided in the interior of the carrier pipe, the latter being provided with through-openings for the conductors. In order that the connecting lines between the 3-dB couplers K1 to K4 and the transmitters S1 to S4 connected thereto be as short as possible, it is recommended that in such case the transmitters be set up at the same elevation within the storied arrangement as the 3-dB couplers and the transmitting antennas.

If the transmitting frequencies employed are in the range of about 450 MHz, then for example twelve of the described structural units, each having four transmitters, four directional antennas, and four 3-dB couplers, can be arranged as a tower having a height of only about 3 meters. If, furthermore, one uses for the directional antennas A1 to A4 angular reflector antennas, which are similar to the known corner reflector antennas, and have an aperture angle of about 0.7×0.7 meters, then the base surface for the tower will be about 2×2 meters.

I claim:

1. A non-directional transmitting system simultaneously and non-directionally transmitting four signals having different but closely spaced frequencies, comprising, in combination a first, second, third and fourth transmitting antenna (A1 to A4), the four antennas being identical directional antennas, the four antennas being oriented so as to face in respective directions each spaced from the next by 90°, a first, second, third and fourth signal source (S1 to S4), each producing a respective one of said four signals, a first, second, third and fourth 3-dB coupler (K1 to K4), each 3-dB coupler being four-port and having a first (1), second (2), third (3) and fourth (4) port, the second port of the first couplter (K1-2) being connected to the first port of the fourth coupler (K4-1), the second port of the fourth coupler (K4-2) being connected to the first port of the third coupler (K3-1), the second port of the third coupler (K3-2) being connected to the first port of the second coupler (K2-1), the second port of the second coupler (K2-2) being connected to the first port of the first coupler (K1-1), the first source (S1) feeding into the third port of the first coupler (K1-3), the second source (S2) feeding into the fourth port of the first coupler (K1-4), the third source (S3) feeding into the fourth port of the third coupler (K3-4), the fourth source (S4) feeding into the third port of the third coupler (K3-3), the first antenna (A1) being fed from the third port of the second coupler (K2-3), the second antenna (A2) being fed from the fourth port of the second coupler (K2-4), the third antenna (A3) being fed from the fourth port of the fourth coupler (K4-4), the fourth antenna (A4) being fed from the third port of the fourth coupler (K4-3).

2. The transmitting system defined in claim 1, each 3-dB coupler having one branch (1-4) of length $3\lambda/4$ and three other branches (1-3, 3-2, 2-4), of length $\lambda/4$.

3. The transmitting system defined in claim 1, each directional antenna (A1 to A4) being a vertically polarized angular reflector antenna having a lobe-shaped directive pattern.

4. The transmitting system defined in claim 3, the aperture angle of the directive pattern of each angular reflector antenna being 90°.

5. The transmitting system defined in claim 3, the aperture angle of the directive pattern of each angular reflector antenna (A1 to A4) being greater than 90° and so selected that the radiation intensity of the directive pattern, at ±45° deviation from the principal and symmetry axis of the antenna, is approximately 3 dB smaller than that of the principal axis of the antenna.

6. The transmitting system defined in claim 5, further including a first $\lambda/4$ time-delay stage (L5) connecting the fourth port of the second coupler (K2-4) to the input of the second antenna (A2), and a second $\lambda/4$ time-delay stage (L5) connecting the third port of the fourth coupler (K4-3) to the input of the fourth antenna (A4).

7. The transmitting system defined in claim 1, the four directional antennas being secured at a common vertical height to a carrier pipe, the four 3-dB couplers being accommodated in the interior of the carrier pipe.

8. The transmitting system defined in claim 7, the four signal sources, four antennas and four couplers together constituting a first set of components; the transmitting system furthermore including further sets of components, each further set of components being of the same construction as the first set of components, the four antennas of each further set of components likewise being secured at a respective common elevation to said carrier pipe with their respective four 3-dB couplers likewise being accommodated within the interior of said carrier pipe.

* * * * *